US006028498A

United States Patent [19]

Bickford

[11] Patent Number: 6,028,498

[45] Date of Patent: Feb. 22, 2000

[54] LOW INDUCTANCE INTERCONNECT HAVING A COMB-LIKE RESILIENT STRUCTURE

[75] Inventor: Joel D. Bickford, Santa Rosa, Calif.

[73] Assignee: Hewlett-Packard Company, Palo Alto, Calif.

[21] Appl. No.: 08/924,371

[22] Filed: Sep. 5, 1997

[51] Int. Cl.[7] ..... H01P 1/04

[52] U.S. Cl. ..... 333/260; 333/99 R; 333/22 R

[58] Field of Search ..... 333/260, 99 R, 333/22 R

[56] References Cited

U.S. PATENT DOCUMENTS

| | | | |
|---|---|---|---|
| 3,221,286 | 11/1965 | Fedde | 333/260 X |
| 3,582,833 | 6/1971 | Kordos | 333/22 R |
| 3,795,037 | 3/1974 | Luttmer | 333/260 X |
| 3,795,884 | 3/1974 | Kotaka | 333/246 |
| 4,394,633 | 7/1983 | Klein | 33/246 X |
| 5,432,486 | 7/1995 | Wong | 333/260 |

FOREIGN PATENT DOCUMENTS

| | | | |
|---|---|---|---|
| 238102 | 10/1986 | Japan | 333/22 R |
| 4291501 | 10/1992 | Japan | 333/260 |
| 6188602 | 7/1994 | Japan | 333/99 R |

*Primary Examiner*—Benny Lee

[57] ABSTRACT

A low inductance interconnect suitable for microwave frequency interconnect applications. The invention provides a low inductance interconnect structure providing interconnection operable from DC to beyond 100 Ghz. The structure may be in the form of a resilient comb, and can be cut from thin sheet metal with a Wire Electric Discharge Machine (EDM). Other resilient forms include spring structures, resilient canes and conductive fuzz.

2 Claims, 2 Drawing Sheets

LOW INDUCTANCE INTERCONNECT HAVING A COMB-LIKE RESILIENT STRUCTURE

FIELD OF USE

The invention relates to low inductance electrical interconnects, and more particularly, to the creation of low inductance connections between microwave circuit components or between circuits and neighboring surfaces.

BACKGROUND

Eliminating unwanted reactance at high frequencies is a perennial design challenge. Circuits operating at high frequencies have many special design considerations, both for the devices and for the circuits. Inductance is a cause of reactance, i.e. the way a circuit "reacts" to changes in alternating current or voltage. Devices have characteristic inductance: a characteristic tendency to impede change in current passing through the device or component. The resistance to change, i.e. this sort of inertia or sluggishness, must be minimized especially in high frequency devices in order that suitable performance can be attained. Components in high frequency applications often require low inductance interconnects.

"Slab line" transmission lines are commonly used in the construction of microwave and millimeter wave frequency components. These transmission lines typically have a center conductor of round or rectangular cross section which is generally placed equidistant from two parallel conducting ground plates.

The end of the slab line center conductor often must be terminated in resistance equal to the line's characteristic impedance to avoid reflection. Moreover slab line components including ground plates often need to be removed during assembly or rework.

Previous approaches to slab line termination required the thin film termination circuit to be soldered into a round outer cartridge. The cartridge was then inserted from a outer edge of the component. Contact to the slab line center conductor was effected through a springy bellows or collet contact placed in the end of the center conductor. In order to operate at frequencies above 100 GHz, the center conductors must be of very small cross section and bellows and collets are not available in this size range.

Another approach to slab line termination required the vertical installation of the circuit between two conducting planes. This configuration precludes easy removal or reinstallation of the ground planes. Such removal or reinstallation capability is often an important feature, especially for assembly or reworking.

What is needed is a low inductance interconnect operable at microwave and millimeter wave frequencies that is easy to rework during test and assembly. It is also desirable that such a connection provide terminal resistance matching or equal to characteristic impedance. Further, it is desirable that such a connection be manufacturable at and within the dimensions required for microwave connections.

SUMMARY OF THE INVENTION

The invention provides a low inductance interconnect suitable for a large variety of interconnect applications, including microwave and RF frequencies. The invention provides a low inductance interconnect by means of a conductive flexible comb or other similar flexible connective conductor. The comb can be cut from thin sheet metal with a Wire Electric Discharge Machine (EDM). The comb provides a low inductance path and good electrical connection. The flexible interconnect permits interconnection operable from DC to beyond 100 Ghz. The comb may be coupled by solder, conductive adhesive, or any other suitable means. Other flexible conductors include metal sponges, conductive elastomers, and other similar flexible conductive configurations such as springs or irregular metallic strands described as "fuzz".

DETAILED DESCRIPTION OF THE PREFERRED EMBODIMENT

The invention provides a flexible conductive structure suitable for a low inductance interconnect. The preferred embodiment provides application of the comb as an interconnect suitable for a slab line transmission line such as are commonly used in the construction of microwave and millimeter wave components.

Figure 1A:
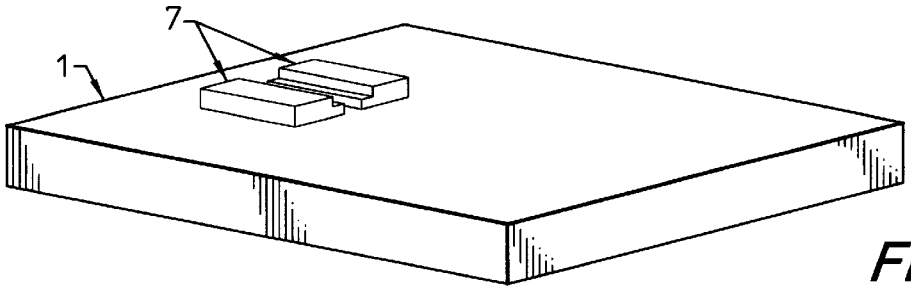
FIG. 1A shows a ground lane of a slab line termination with a pair of conductive metal ledges.
Figure 1B:
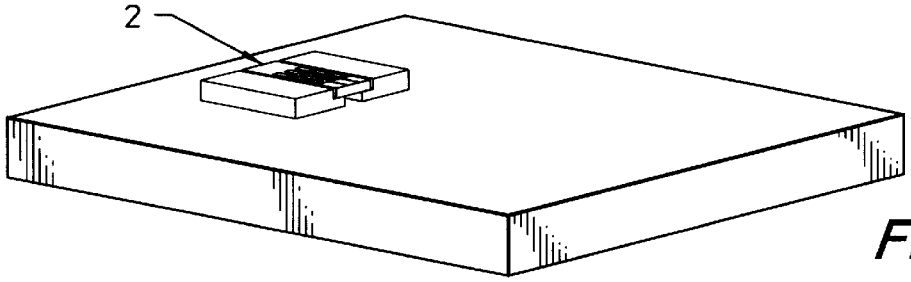
FIG. 1B shows a thin film circuit attached to the conductive metal ledges of FIG. 1A.
Figure 1C:
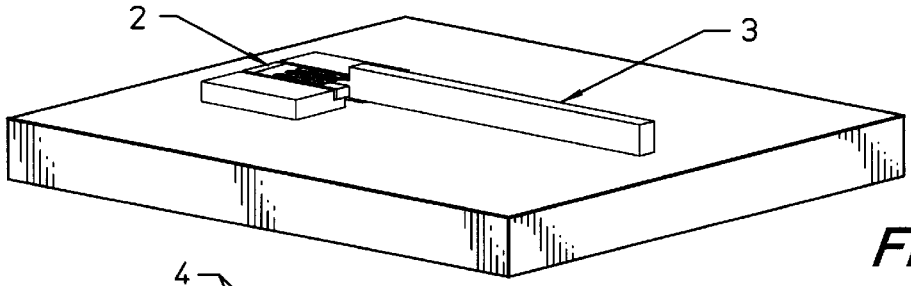
FIG. 1C shows with the thin film circuit of FIG. 1B.
Figure 1D:
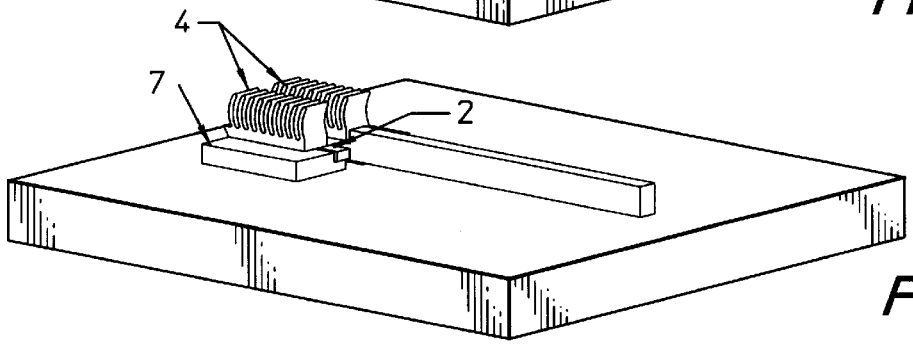
FIG. 1D shows a pair of flexible combs attached to the thin film circuit of FIG. 1B.

As depicted in FIG. 1D, the comb 4 has been cut from uniform thickness sheet metal. The cutting has been done using a Wire Electric Discharge Machine (EDM) with a 0.001 inch diameter wire. The comb 4 has a very fine tooth pitch and is small enough to function in circuits operating at or above 100 Ghz. Comb height is about 0.4 millimeters for microwave applications, although the height can vary according to the application and design.

FIGS. 1A through 1E depicts a slab line transmission line termination using the inventive spring comb. FIG. 1A shows the ground plane 1 of such a slab transmission termination and a pair of conductive metal ledges 7. A thin film circuit 2 of any desired type is shown as attached to the conductive metal ledges in FIG. 1B. A center conductor 3 is shown in FIG. 1C; the center conductor is approximately perpendicularly in contact with an edge of the thin film circuit 2. FIG. 1D shows a pair of flexible conductive combs 4 attached to the upper surface of the thin film circuit 2 and to the conductive metal ledges 7.

Figure 1E:
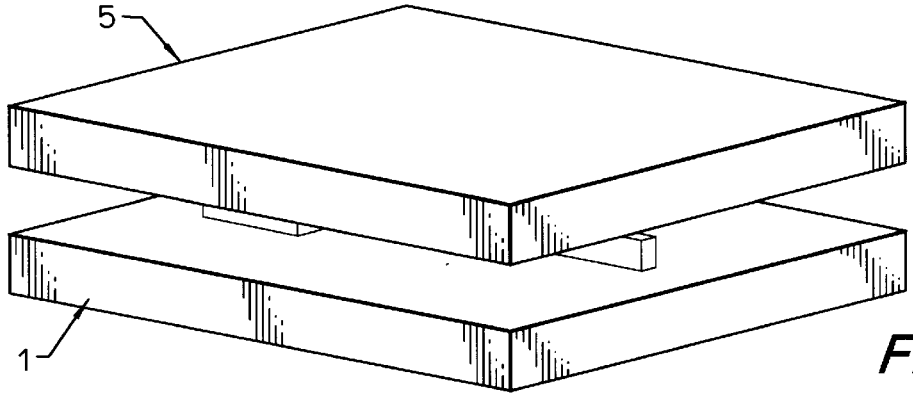
FIG. 1E shows a top ground plane added to the apparatus of FIG. 1D.

FIG. 1E depicts the addition of a top ground plane 5 to the apparatus as depicted in FIG. 1D, the top ground plane 5 being generally parallel to the base ground plane 1. The comb allows the current in the outer conductor to flow to the ground side of the terminating register and complete the circuit.

Figure 2:
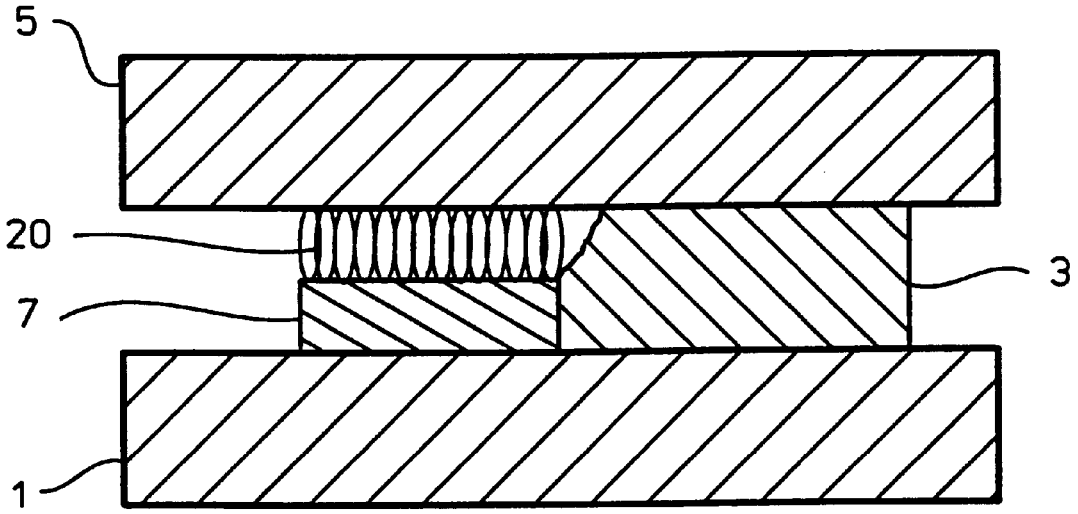
FIG. 2 illustrates an alternate embodiment of the invention.
Figure 3:
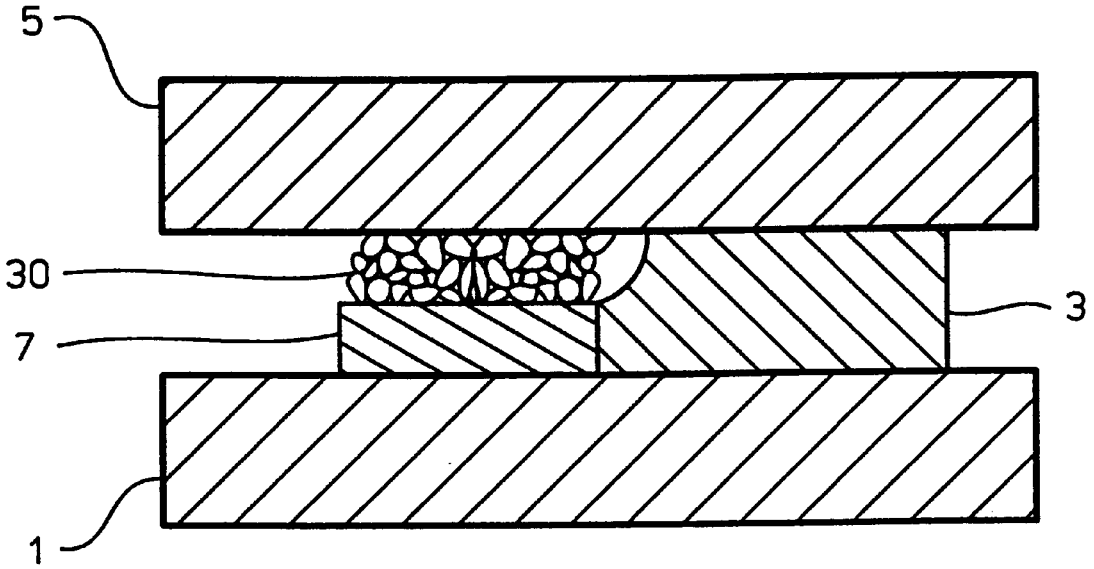
FIG. 3 illustrates an alternate embodiment of the invention.

Alternate flexible conductive structures are possible. FIGS. 2 and 3 illustrate alternative embodiments in which like numerals indicate like components already described with respect to FIG. 1A spring 20 may be used as depicted in FIG. 2. However, upon compression, the spring assumes an elliptical cross section and the inductance may not be as low as in the preferred comb embodiment.

An alternate embodiment (not shown) provides what may be described as "cane" shaped conductive protrusions uprightly affixed in some supporting base material. Such base material may be selected from a host of elastomers or conductive plastics, or any suitable material into which the conductive metallic protrusions may be planted upright. The metallic protrusions may be formed in any of a number of manners, including extrusion or strip cutting by EDM. The protrusions are flexible and perform essentially in the same manner as the comb teeth in the preferred embodiment. An alternative embodiment as depicted in FIG. 3 provides an irregular flexible conductive member 30 such as may be described as "fuzz".

The foregoing description of the preferred embodiment of the invention is presented for illustrative and descriptive purposes. It is not intended to be exhaustive or to limit the invention to the precise form disclosed. Obvious modifications or variations are possible in light of the above teaching. The chosen embodiment best illustrates the principles of the invention and its practical application to thereby enable one of ordinary skill in the art to best utilize the invention in various embodiments and with various modifications as may be suitable for the contemplated use. The scope of the invention to be defined by the claims appended hereto.

I claim:

1. A low inductance interconnect for devices capable of operating from DC to above 100 GHz comprising:

a base ground plane structure having a pair of conductive metal ledges;

a thin film circuit attached to the metal ledges;

a center conductor approximately perpendicularly contacted with an edge of the thin film circuit;

a comb-like resilient structure of conductive material attached to an upper surface of the film circuit and the conductive metal ledges wherein the comb-like resilient structure has teeth which are finely pitched and of a height of about 0.4 mm.

2. An interconnect as in claim 1, including a top ground plane on top of the resilient structure and generally parallel to the base ground plane.

* * * * *